US007710366B2

(12) United States Patent
Lee et al.

(10) Patent No.: US 7,710,366 B2
(45) Date of Patent: May 4, 2010

(54) DISPLAY DEVICE AND DRIVING METHOD THEREOF

(75) Inventors: Jae-Hoon Lee, Seoul (KR); Bong-Hyun You, Gyeonggi-do (KR); Min-Koo Han, Seoul (KR)

(73) Assignee: Samsung Electronics Co., Ltd., Gyeonggi-do (KR)

( * ) Notice: Subject to any disclaimer, the term of this patent is extended or adjusted under 35 U.S.C. 154(b) by 1200 days.

(21) Appl. No.: 11/133,878

(22) Filed: May 19, 2005

(65) Prior Publication Data

US 2005/0259051 A1 Nov. 24, 2005

(30) Foreign Application Priority Data

May 20, 2004 (KR) ..... 10-2004-0035944

(51) Int. Cl.
*G09G 3/32* (2006.01)

(52) U.S. Cl. ..... 345/82; 345/46; 345/83; 315/169.1; 315/169.3; 313/504

(58) Field of Classification Search ..... 345/39, 345/44, 76, 77, 82, 83; 315/169.1–169.4
See application file for complete search history.

(56) References Cited

U.S. PATENT DOCUMENTS 6,229,506 B1 * 5/2001 Dawson et al. ..... 345/82
7,015,884 B2 * 3/2006 Kwon ..... 345/78
7,046,240 B2 * 5/2006 Kimura ..... 345/212
7,109,952 B2 * 9/2006 Kwon ..... 345/76
7,154,454 B2 * 12/2006 Okabe et al. ..... 345/76
2003/0142046 A1 7/2003 Kasai et al.
2006/0244687 A1 * 11/2006 Fish et al. ..... 345/76

FOREIGN PATENT DOCUMENTS

CN 1460240 12/2003
EP 1372132 A1 12/2003

(Continued)

OTHER PUBLICATIONS

Patent Abstracts of Japan, Publication No. 2003-022050, Jan. 24, 2003, 1 p.

(Continued)

*Primary Examiner*—Richard Hjerpe
*Assistant Examiner*—Jennifer T Nguyen
(74) *Attorney, Agent, or Firm*—Innovation Counsel LLP

(57) ABSTRACT

Each pixel includes: a light emitting element; a capacitor; a driving transistor that has a control terminal, an input terminal, and an output terminal and supplies a driving current to the light emitting element to emit light; a first switching unit that diode-connects the driving transistor and supplies a data voltage to the driving transistor in response to a scanning signal; and a second switching unit that supplies a driving voltage to the driving transistor and connects the light emitting element and the capacitor to the driving transistor in response to an emission signal, wherein the capacitor is connected to the driving transistor through the first switching unit, stores a control voltage being a function of the data voltage and the threshold voltage of the driving transistor, and is connected to the driving transistor through the second switching unit to supply the control voltage to the driving transistor.

16 Claims, 9 Drawing Sheets

FOREIGN PATENT DOCUMENTS

| | | |
|---|---|---|
| JP | 2003-22050 | 1/2003 |
| JP | 2003-99001 | 4/2003 |
| JP | 2003-255896 | 9/2003 |
| JP | 2004-46110 | 2/2004 |
| JP | 2004-77567 | 3/2004 |
| JP | 2004-079509 | 3/2004 |
| KR | 2003-0004048 | 1/2003 |
| KR | 2003-0066790 | 8/2003 |
| KR | 2003-0095215 | 12/2003 |
| KR | 2004-0030320 | 4/2004 |
| WO | WO 03/038790 | 5/2003 |

OTHER PUBLICATIONS

Patent Abstracts of Japan, Publication No. 2003-099001, Apr. 4, 2003, 1 p.

Patent Abstracts of Japan, Publication No. 2003-255896, Sep. 10, 2003, 1 p.

Patent Abstracts of Japan, Publication No. 2004-046110, Feb. 12, 2004, 1 p.

Patent Abstracts of Japan, Publication No. 2004-077567, Mar. 11, 2004, 1 p.

Patent Abstracts of Japan, Publication No. 2004-079509, Mar. 11, 2004, 1 p.

Korean Patent Abstracts, Publication No. 1020030004048, Jan. 14, 2003, 1 p.

English Language Abstract, Publication No. WO02054373 (Korean Patent Abstracts, Publication No. 2003-0066790, Aug. 9, 2003), 2 pp.

Korean Patent Abstracts, Publication No. 1020030095215, Dec. 18, 2003, 1 p.

Korean Patent Abstracts, Publication No. 1020040030320, Apr. 9, 2004, 1 p.

Ono, S., et al., "Pixel Circuit for a-Si AM-OLED," *International Display Technology*, 2003, pp. 25-258.

* cited by examiner

DISPLAY DEVICE AND DRIVING METHOD THEREOF

BACKGROUND OF THE INVENTION (a) Field of the Invention

The present invention relates to a display device and a driving method thereof, and in particular, a light emitting display device and a driving method thereof.

(b) Description of Related Art

Recent trends of light-weighted and thin personal computers and televisions sets also require light-weighted and thin display devices, and flat panel displays satisfying such a requirement is being substituted for conventional cathode ray tubes (CRT).

The flat panel displays include a liquid crystal display (LCD), field emission display (FED), organic light emitting display (OLED), plasma display panel (PDP), and so on.

Generally, an active matrix flat panel display includes a plurality of pixels arranged in a matrix and displays images by controlling the luminance of the pixels based on given luminance information. An OLED is a self-emissive display device that displays image by electrically exciting light emitting organic material, and it has low power consumption, wide viewing angle, and fast response time, thereby being advantageous for displaying motion images.

A pixel of an OLED includes a light emitting element and a driving thin film transistor (TFT). The light emitting element emits light having an intensity depending on the current driven by the driving TFT, which in turn depends on the threshold voltage of the driving TFT and the voltage between gate and source of the driving TFT.

The TFT includes polysilicon or amorphous silicon. A polysilicon TFT has several advantages, but it also has disadvantages such as the complexity of manufacturing polysilicon, thereby increasing the manufacturing cost. In addition, it is difficult to make an OLED employing polysilicon TFTs for large displays.

On the contrary, an amorphous silicon TFT is easily applicable to a large OLED and manufactured using fewer number of process steps than the polysilicon TFT. However, the threshold voltage of the amorphous silicon TFT shifts over time under a long-time application of a DC control voltage such that the luminance is varied for a given data voltage.

In the meantime, a long time driving of the light emitting element shifts the threshold voltage of the light emitting element. As for an OLED employing an n-type driving TFT, since the light emitting element is connected to the source of the driving TFT, the shift of the threshold voltage of the light emitting element changes the voltage at the source of the driving TFT to vary the current driven by the driving TFT. Accordingly, the image quality of the OLED may be degraded.

SUMMARY OF THE INVENTION

The present invention solves the problems of conventional techniques.

A display device including a plurality of pixels is provided. Each pixel includes: a light emitting element; a capacitor; a driving transistor that has a control terminal, an input terminal, and an output terminal and supplies a driving current to the light emitting element to emit light; a first switching unit that diode-connects the driving transistor and supplies a data voltage to the driving transistor in response to a scanning signal; and a second switching unit that supplies a driving voltage to the driving transistor and connects the light emitting element and the capacitor to the driving transistor in response to an emission signal, wherein the capacitor is connected to the driving transistor through the first switching unit, stores a control voltage being a function of the data voltage and the threshold voltage of the driving transistor, and is connected to the driving transistor through the second switching unit to supply the control voltage to the driving transistor.

The first switching unit may include: a first switching transistor connecting the control terminal and the input terminal of the driving transistor in response to the scanning signal; and a second switching transistor connecting the output terminal of the driving transistor to the data voltage in response to the scanning signal.

The first switching unit may further include a third switching transistor supplies a reference voltage to the capacitor in response to the scanning signal.

The second switching unit may include: a fourth switching transistor connecting the input terminal of the driving transistor to the driving voltage in response to the emission signal; a fifth switching transistor connecting the light emitting element and the output terminal of the driving transistor in response to the emission signal; and a sixth switching transistor connecting the capacitor and the output terminal of the driving transistor in response to the emission signal.

The control voltage may be equal to sum of the data voltage and the threshold voltage subtracted by the reference voltage.

The first to the sixth switching transistors and the driving transistor may include amorphous silicon thin film transistors and may include NMOS thin film transistors.

The light emitting element may include an organic light emitting layer.

A display device is provided, which includes: a light emitting element; a driving transistor having a first terminal connected to a first voltage, a second terminal connected to the light emitting element, and a control terminal; a capacitor connected between the second terminal and the control terminal of the driving transistor; a first transistor that operates in response to the scanning signal and is connected between the first terminal and the control terminal of the driving transistor; a second transistor that operates in response to the scanning signal and is connected between the second terminal of the driving transistor and a data voltage; a third transistor that operates in response to the emission signal and is connected between the first voltage and the first terminal of the driving transistor; a fourth transistor that operates in response to the emission signal and is connected between the light emitting element and the second terminal of the driving transistor; and a fifth transistor that operates in response to the emission signal and is connected between the capacitor and the second terminal of the driving transistor.

The display device may further include a sixth transistor that operates in response to the scanning signal and is connected between the capacitor and a second voltage.

During first to fourth time periods in series, the first to the sixth transistors turn on during the first time period; the first, the second, and the sixth transistors turn on and the third to fifth transistors turn off during the second time period; the first to the sixth transistors turn off during the third time period; and the first, the second, and the sixth transistors turn off and the third to fifth transistors turn on during the fourth time period.

The first voltage may be higher than the data voltage and the second voltage is lower than the data voltage.

A method of driving a display device including a light emitting element, a driving transistor having a control terminal and first and second terminals, and a capacitor connected to the control terminal of the driving transistor is provided, which includes: connecting the control terminal and the first terminal of the driving transistor; applying a data voltage to the second terminal of the driving transistor; connecting the capacitor between the control terminal and the second terminal of the driving transistor; connecting the first terminal of the driving transistor to a driving voltage; and connecting the second terminal of the driving transistor to the light emitting element.

The method may further include: applying a first voltage higher than the data voltage to the control terminal of the driving transistor to charge the capacitor.

The method may further include: isolating the control terminal and the first terminal of the driving transistor after the connection of the control terminal and the first terminal of the driving transistor.

The method may further include: separating the capacitor and the driving transistor from external signal sources.

A method of driving a display device including a light emitting element, a driving transistor connected to the light emitting element, and a capacitor connected to the driving transistor and the light emitting element is provided, which includes: charging a voltage onto the capacitor; discharging the voltage stored in the capacitor toward a data voltage through the driving transistor; applying the voltage of the capacitor after the discharge to the driving transistor to turn on the driving transistor; and supplying a driving current to the light emitting element through the driving transistor to emit light.

BRIEF DESCRIPTION OF THE DRAWINGS

The present invention will become more apparent by describing embodiments thereof in detail with reference to the accompanying drawing in which.

DETAILED DESCRIPTION OF THE PREFERRED EMBODIMENTS

Figure 1:
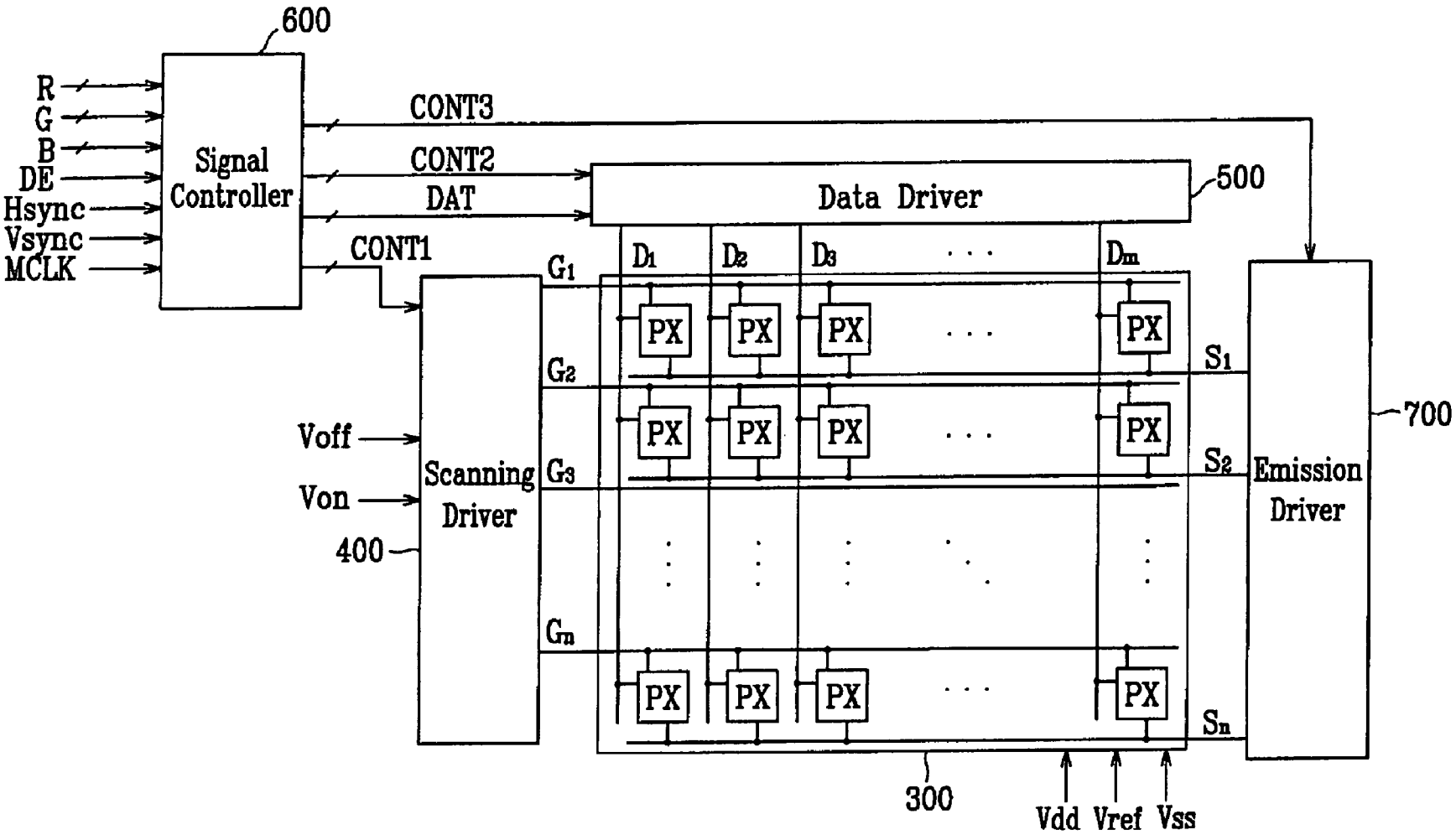
FIG. 1 is a block diagram of an OLED according to an embodiment of the present invention.

The present invention will now be described more fully hereinafter with reference to the accompanying drawings, in which preferred embodiments of the invention are shown.

In the drawings, the thickness of layers and regions are exaggerated for clarity. Like numerals refer to like elements throughout. It will be understood that when an element such as a layer, region or substrate is referred to as being "on" another element, it can be directly on the other element or intervening elements may also be present. In contrast, when an element is referred to as being "directly on" another element, there are no intervening elements present.

Then, display devices and driving methods thereof according to embodiments of the present invention will be described with reference to the accompanying drawings.

Referring to FIGS. 1-7, an organic light emitting display (OLED) according to an embodiment of the present invention will be described in detail.

Figure 2:
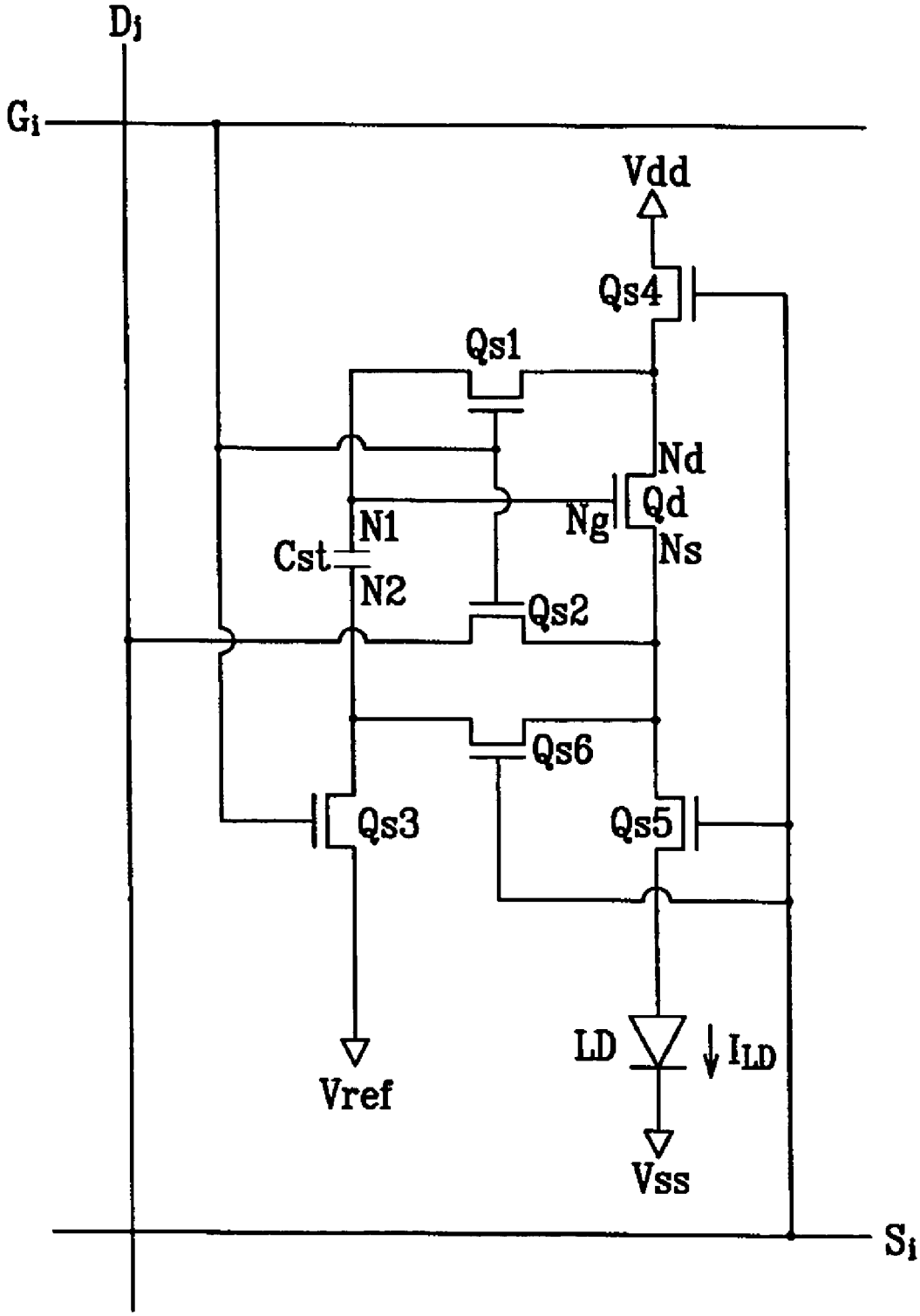
FIG. 2 is an equivalent circuit diagram of a pixel of an OLED according to an embodiment of the present invention.

FIG. 1 is a block diagram of an OLED according to an embodiment of the present invention and FIG. 2 is an equivalent circuit diagram of a pixel of an OLED according to an embodiment of the present invention.

Referring to FIG. 1, an OLED according to an embodiment includes a display panel 300, three drivers including a scanning driver 400, a data driver 500, and an emission driver 700 that are connected to the display panel 300, and a signal controller 600 controlling the aforementioned drivers.

Referring to FIG. 1, the display panel 300 includes a plurality of signal lines, a plurality voltage lines (not shown), and a plurality of pixels PX connected thereto and arranged substantially in a matrix.

The signal lines include a plurality of scanning lines $G_1$-$G_n$ transmitting scanning signals, a plurality of data lines $D_1$-$D_m$ transmitting data signals, and a plurality of emission lines $S_1$-$S_n$ transmitting emission signals. The scanning lines $G_1$-$G_n$ and the emission lines $S_1$-$S_n$ extend substantially in a row direction and substantially parallel to each other, while the data lines $D_1$-$D_m$ extend substantially in a column direction and substantially parallel to each other.

Referring to FIG. 2, the voltage lines include driving voltage lines (not shown) transmitting a driving voltage Vdd and reference voltage lines (not shown) transmitting a reference voltage Vref.

Each pixel PX connected to a scanning line $G_i$ and a data line $D_j$ includes an organic light emitting element LD, a driving transistor Qd, a capacitor Cst, and six switching transistors Qs1-Qs6.

The driving transistor Qd has a control terminal Ng, an input terminal Nd, and an output terminal Ns and the input terminal Nd of the driving transistor Qd is connected to a driving voltage Vdd.

The capacitor Cst is connected between the control terminal Ng and the output terminal Ns of the driving transistor Qd.

The light emitting element LD has an anode connected to the output terminal Ns of the driving transistor Qd and a cathode connected to a common voltage Vcom. The light emitting element LD emits light having an intensity depending on an output current $I_{LD}$ of the driving transistor Qd. The output current $I_{LD}$ of the driving transistor Qd depends on the voltage Vgs between the control terminal Ng and the output terminal Ns.

The switching transistors Qs1-s3 operate in response to the scanning signals.

The switching transistor Qs1 is connected between the input terminal Nd and the control terminal Ng of the driving transistor Qd, the switching transistor Qs2 is connected between a data line $D_j$ and the output terminal Ns of the driving transistor Qd, and the switching transistor Qs3 is connected between the capacitor Cst and the reference voltage Vref.

The switching transistors Qs4-Qs6 operate in response to the emission signal.

The switching transistor Qs4 is connected between the input terminal Nd of the driving transistor Qd and the driving voltage Vdd, the switching transistor Qs5 is connected between the light emitting element LD and the output terminal Ns of the driving transistor Qd, and the switching transistor Qs6 is connected between the capacitor Cst and the output terminal Ns of the driving transistor Qd.

The switching transistors Qs1-Qs6 and the driving transistor Qd are n-channel field effect transistors (FETs) including amorphous silicon or polysilicon. However, the transistors Qs1-Qs6 and Qd may be p-channel FETs operating in a manner opposite to n-channel FETs.

Now, a structure of a light emitting element LD and a switching transistor Qs5 connected thereto shown in FIG. 2 will be described in detail with reference to FIGS. 3 and 4.

Figure 3:
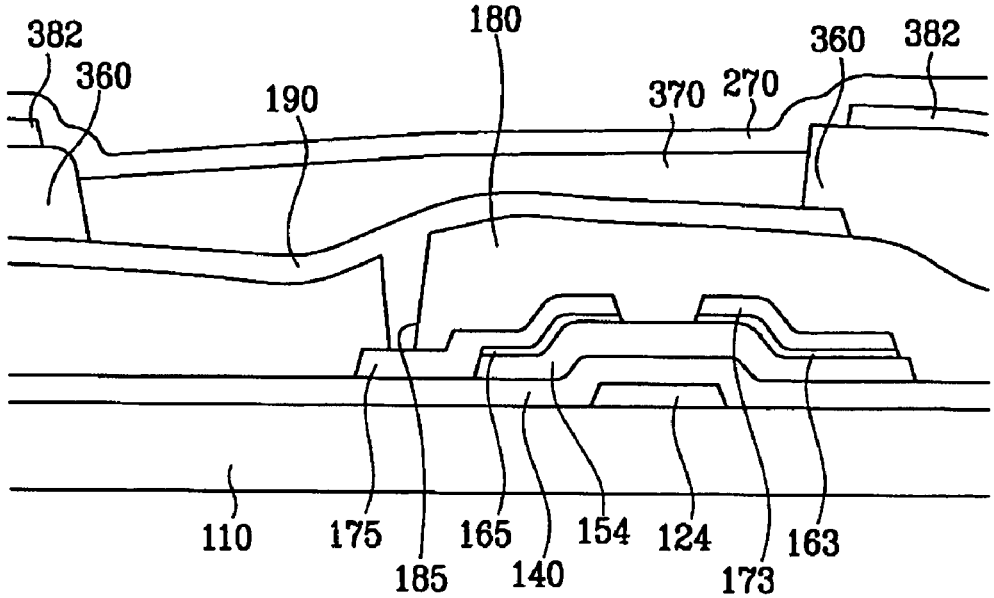
FIG. 3 is an exemplary cross-sectional view of the light emitting element and the switching transistor of FIG. 2.
Figure 4:
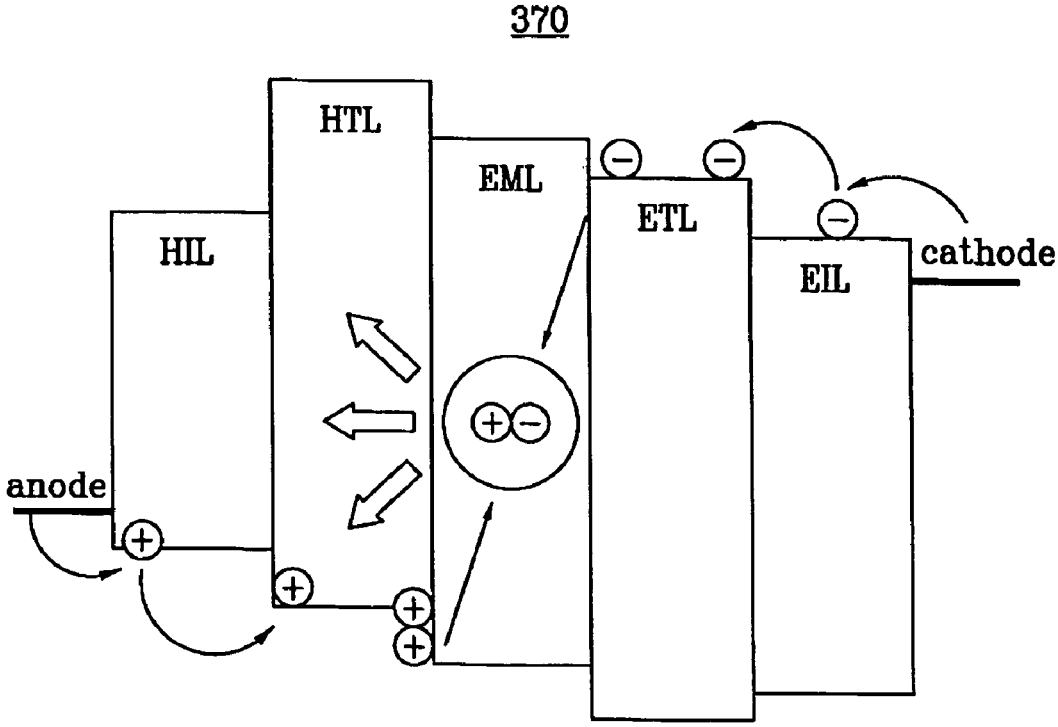
FIG. 4 is a schematic diagram of an organic light emitting element according to an embodiment of the present invention.

FIG. 3 is an exemplary cross-sectional view of a light emitting element LD and a switching transistor Qs5 shown in FIG. 2 and FIG. 4 is a schematic diagram of an organic light emitting element according to an embodiment of the present invention.

A control electrode (or gate electrode) 124 is formed on an insulating substrate 110. The control electrode 124 preferably made of Al containing metal such as Al and Al alloy, Ag containing metal such as Ag and Ag alloy, Cu containing metal such as Cu and Cu alloy, Mo containing metal such as Mo and Mo alloy, Cr, Ti or Ta. The control electrode 124 may have a multi-layered structure including two films having different physical characteristics. One of the two films is preferably made of low resistivity metal including Al containing metal, Ag containing metal, and Cu containing metal for reducing signal delay or voltage drop. The other film is preferably made of material such as Mo containing metal, Cr, Ta or Ti, which has good physical, chemical, and electrical contact characteristics with other materials such as indium tin oxide (ITO) or indium zinc oxide (IZO). Good examples of the combination of the two films are a lower Cr film and an upper Al (alloy) film and a lower Al (alloy) film and an upper Mo (alloy) film. However, the gate electrode 124 may be made of various metals or conductors. The lateral sides of the gate electrode 124 are inclined relative to a surface of the substrate, and the inclination angle thereof ranges about 30-80 degrees.

An insulating layer 140 preferably made of silicon nitride (SiNx) is formed on the control electrode 124.

A semiconductor 154 preferably made of hydrogenated amorphous silicon (abbreviated to "a-Si") or polysilicon is formed on the insulating layer 140, and a pair of ohmic contacts 163 and 165 preferably made of silicide or n+ hydrogenated a-Si heavily doped with n type impurity such as phosphorous are formed on the semiconductor 154. The lateral sides of the semiconductor 154 and the ohmic contacts 163 and 165 are inclined relative to the surface of the substrate, and the inclination angles thereof are preferably in a range of about 30-80 degrees.

An input electrode 173 and an output electrode 175 are formed on the ohmic contacts 163 and 165 and the insulating layer 140. The input electrode 173 and the output electrode 175 are preferably made of refractory metal such as Cr, Mo, Ti, Ta or alloys thereof. However, they may have a multilayered structure including a refractory metal film (not shown) and a low resistivity film (not shown). Good example of the multi-layered structure are a double-layered structure including a lower Cr/Mo (alloy) film and an upper Al (alloy) film and a triple-layered structure of a lower Mo (alloy) film, an intermediate Al (alloy) film, and an upper Mo (alloy) film. Like the gate electrode 124, the input electrode 173 and the output electrode 175 have inclined edge profiles, and the inclination angles thereof range about 30-80 degrees.

The input electrode 173 and the output electrode 175 are separated from each other and disposed opposite each other with respect to the gate electrode 124. The control electrode 124, the input electrode 173, and the output electrode 175 as well as the semiconductor 154 form a TFT serving as a switching transistor Qs5 having a channel located between the input electrode 173 and the output electrode 175.

The ohmic contacts 163 and 165 are interposed only between the underlying semiconductor stripes 154 and the overlying electrodes 173 and 175 thereon and reduce the contact resistance therebetween. The semiconductor 154 includes an exposed portion, which are not covered with the input electrode 173 and the output electrode 175.

A passivation layer 180 is formed on the electrode 173 and 175, the exposed portion of the semiconductor 154, and the insulating layer 140. The passivation layer 180 is preferably made of inorganic insulator such as silicon nitride or silicon oxide, organic insulator, or low dielectric insulating material. The low dielectric material preferably has dielectric constant lower than 4.0 and examples thereof are a-Si:C:O and a-Si:O:F formed by plasma enhanced chemical vapor deposition (PECVD). The organic insulator may have photosensitivity and the passivation layer 180 may have a flat surface. The passivation layer 180 may have a double-layered structure including a lower inorganic film and an upper organic film so that it may take the advantage of the organic film as well as it may protect the exposed portions of the semiconductor 154. The passivation layer 180 has a contact hole 185 exposing a portion of the output electrode 175.

A pixel electrode 190 is formed on the passivation layer 180. The pixel electrode 190 is physically and electrically connected to the output terminal electrode 175 through the contact hole 185 and it is preferably made of transparent conductor such as ITO or IZO or reflective metal such as Cr, Ag or Al.

A partition 360 is formed on the passivation layer 180. The partition 360 encloses the pixel electrode 190 to define an opening on the pixel electrode 190 like a bank, and it is preferably made of organic or inorganic insulating material.

An organic light emitting member 370 is formed on the pixel electrode 190 and it is confined in the opening enclosed by the partition 360.

Referring to FIG. 4, the organic light emitting member 370 has a multilayered structure including an emitting layer EML and auxiliary layers for improving the efficiency of light emission of the emitting layer EML. The auxiliary layers include an electron transport layer ETL and a hole transport layer HTL for improving the balance of the electrons and holes and an electron injecting layer EIL and a hole injecting layer HIL for improving the injection of the electrons and holes. The auxiliary layers may be omitted.

An auxiliary electrode 382 having low resistivity such as Al (alloy) is formed on the partition 360.

A common electrode 270 supplied with a common voltage Vss is formed on the organic light emitting member 370 and the partition 360. The common electrode 270 is preferably made of reflective metal such as Ca, Ba, Cr, Al or Ag, or transparent conductive material such as ITO or IZO.

The auxiliary electrode 382 contacts the common electrode 270 for compensating the conductivity of the common electrode 270 to prevent the distortion of the voltage of the common electrode 270.

A combination of opaque pixel electrodes 190 and a transparent common electrode 270 is employed to form a top emission OLED that emits light toward the top of the display panel 300, and a combination of transparent pixel electrodes 190 and an opaque common electrode 270 is employed to form a bottom emission OLED that emits light toward the bottom of the display panel 300.

A pixel electrode 190, an organic light emitting member 370, and a common electrode 270 form a light emitting element LD having the pixel electrode 190 as an anode and the common electrode 270 as a cathode or vice versa. The light emitting element LD uniquely emits one of primary color lights depending on the material of the light emitting member 370. An exemplary set of the primary colors includes red, green, and blue and the display of images is realized by the addition of the three primary colors.

Referring to FIG. 1 again, the scanning driver 400 is connected to the scanning lines $G_1$-$G_n$ of the display panel 300 to generate scanning signals for application to the scanning lines $G_1$-$G_n$. The scanning driver 400 synthesizes a high level voltage Von for turning on the switching transistors Qs1-Qs3 and a low level voltage Voff for turning off the switching transistors Qs1-Qs3.

The data driver 500 is connected to the data lines $D_1$-$D_m$ of the display panel 300 and applies data signals Vdata to the data lines $D_1$-$D_m$.

The emission driver 700 is connected to the emission lines $S_1$-$S_n$ of the display panel 300 to generate emission signals for application to the emission lines $S_1$-$S_n$. The emission driver 700 synthesizes a high level voltage Von for turning on the switching transistors Qs4-Qs6 and a low level voltage Voff for turning off the switching transistors Qs4-Qs6.

The scanning driver 400, the data driver 500, or the emission driver 700 may be implemented as integrated circuit (IC) chip mounted on the display panel 300 or on a flexible printed circuit (FPC) film in a tape carrier package (TCP) type, which are attached to the display panel 300. Alternately, they may be integrated into the display panel 300 along with the signal lines $G_0$-$G_n$, $D_1$-$D_m$, and $S_1$-$S_n$ and the transistors Qd and Qs1-Qs6.

The signal controller 600 controls the scanning driver 400, the data driver 500, and the emission driver 700.

Now, the operation of the above-described OLED will be described in detail with reference to FIGS. 5-7.

Figure 5:
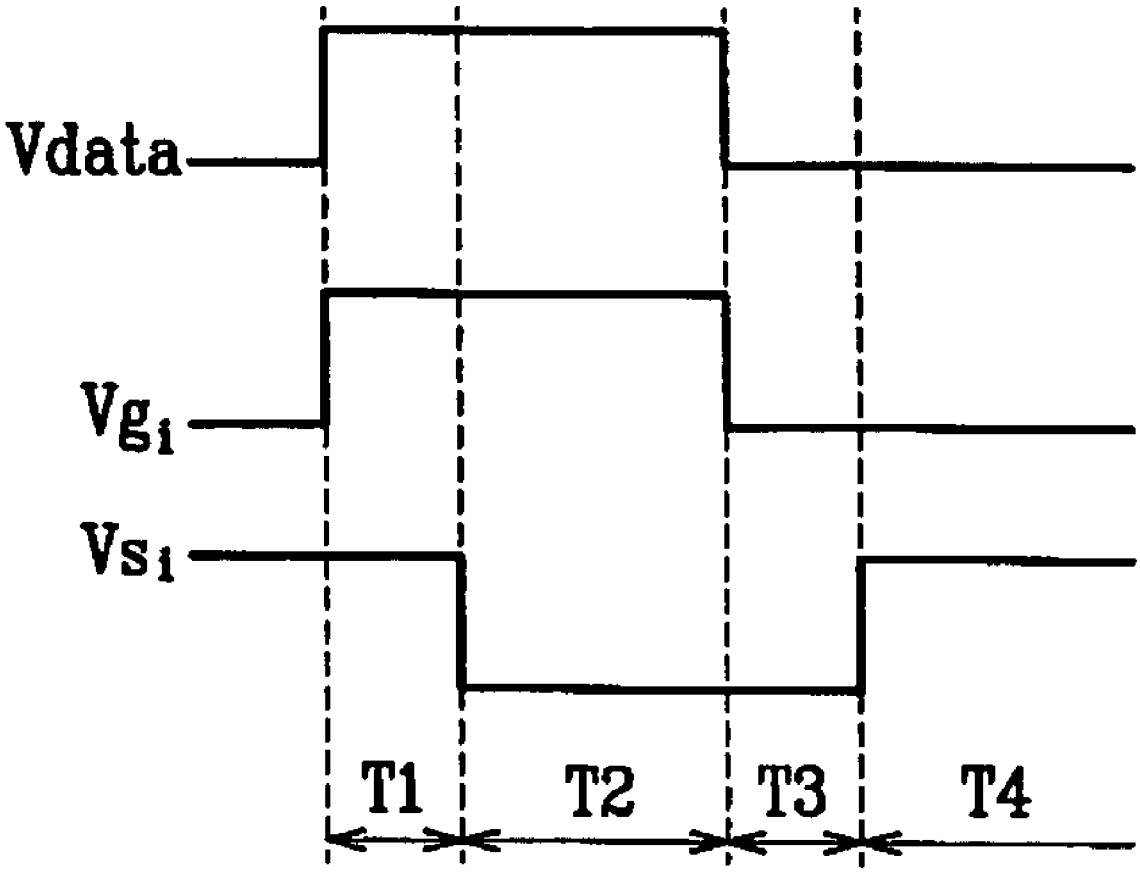
FIG. 5 is a timing chart illustrating several signals for an OLED according to an embodiment of the present invention.
Figure 6A:
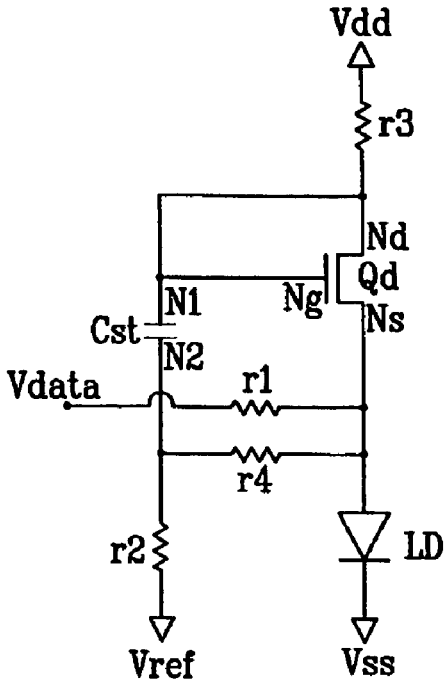
FIGS. 6A-6D are equivalent circuit configurations of a pixel for respective time periods shown in FIG. 5.
Figure 6B:
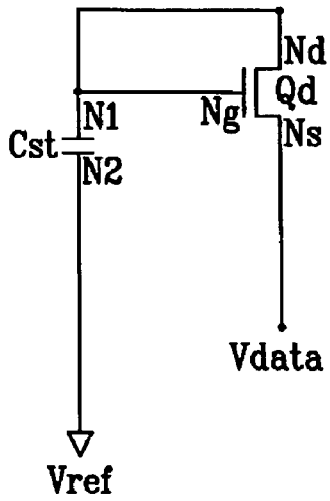
Figure 6C:
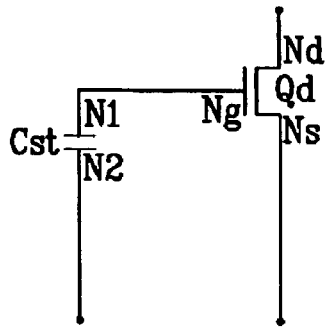
Figure 6D:
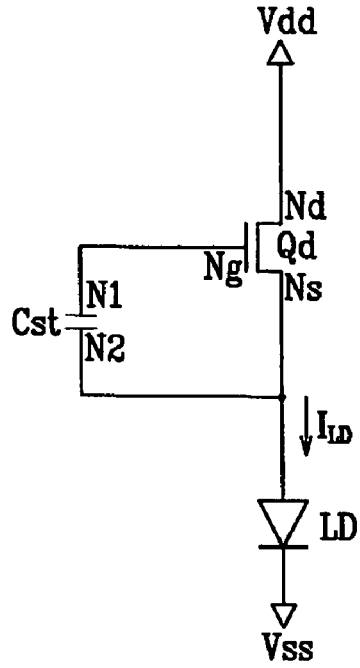
Figure 7:
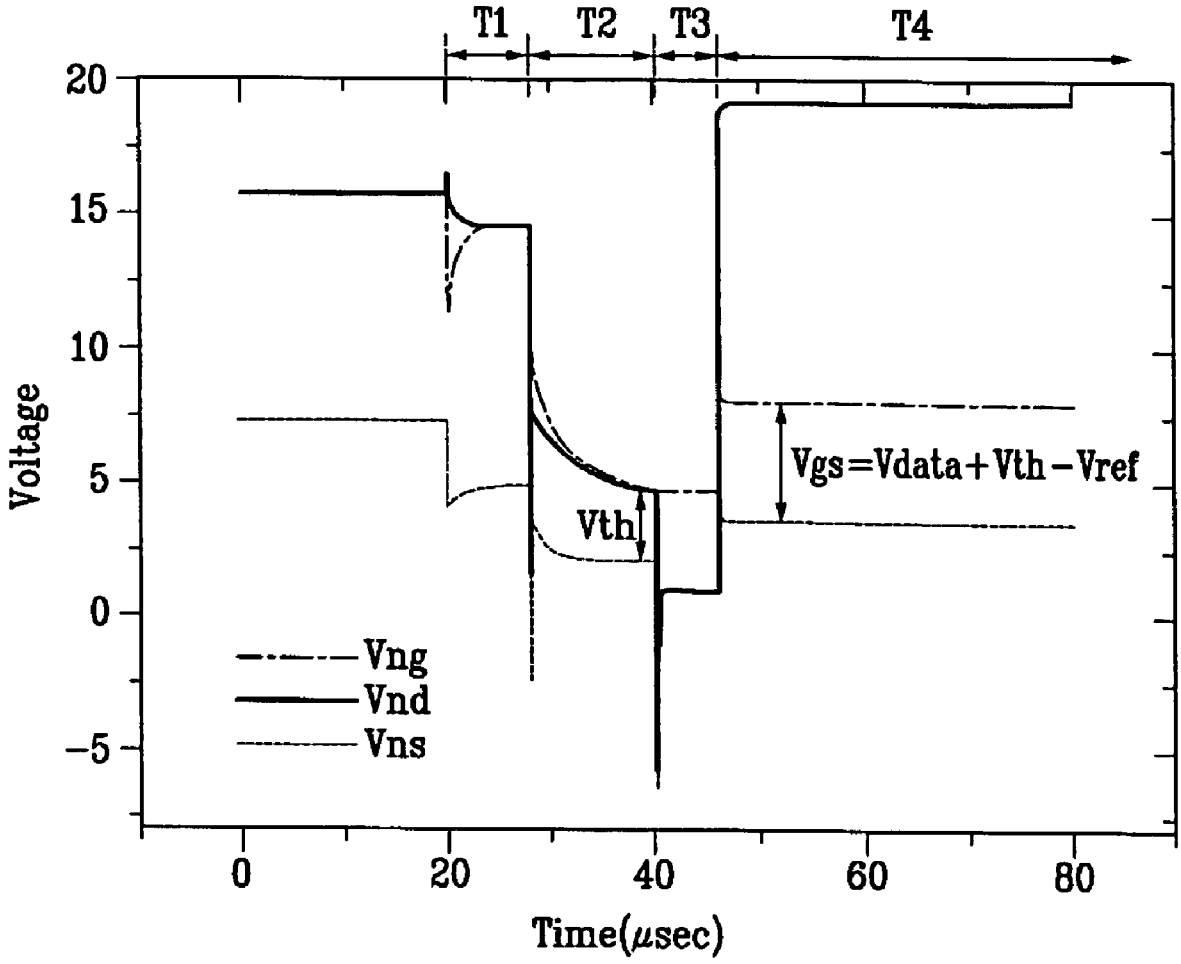
FIG. 7 illustrates waveforms of voltages at the terminals of the driving transistor of an OLED according to an embodiment of the present invention.

FIG. 5 is a timing chart illustrating several signals for an OLED according to an embodiment of the present invention, FIGS. 6A-6D are equivalent circuit configurations of a pixel for respective time periods shown in FIG. 5, and FIG. 7 illustrates waveforms of voltages at the terminals of the driving transistor of an OLED according to an embodiment of the present invention.

The signal controller 600 is supplied with input image signals R, G and B and input control signals controlling the display thereof such as a vertical synchronization signal Vsync, a horizontal synchronization signal Hsync, a main clock MCLK, and a data enable signal DE, from an external graphics controller (not shown). After generating scanning control signals CONT1, data control signals CONT2, and emission control signals CONT3 and processing the image signals R, G and B suitable for the operation of the display panel 300 on the basis of the input control signals and the input image signals R, G and B, the signal controller 600 sends the scanning control signals CONT1 to the scanning driver 400, the processed image signals DAT and the data control signals CONT2 to the data driver 500, and the emission control signals CONT3 to the emission driver 700.

The scanning control signals CONT1 include a scanning start signal STV for instructing to start scanning and at least one clock signal for controlling the output time of the high level voltage Von. The scanning control signals CONT1 may include a plurality of output enable signals for defining the duration of the high level voltage Von.

The data control signals CONT2 include a horizontal synchronization start signal STH for informing of start of data transmission for a group of pixels PX, a load signal LOAD for instructing to apply the data voltages to the data lines $D_1$-$D_m$, and a data clock signal HCLK.

Responsive to the data control signals CONT2 from the signal controller 600, the data driver 500 receives a packet of the image data for a group of pixels PX, for example, the i-th pixel row from the signal controller 600, converts the image data into analog data voltages Vdata, and applies the data signals Vdata to the data lines $D_1$-$D_m$.

The scanning driver 400 makes a scanning signal $Vg_i$ for the i-th scanning signal line $G_i$ equal to the high level voltage Von in response to the scanning control signals CONT1 from the signal controller 600, thereby turning on the switching transistors Qs1-Qs3 connected to the i-th scanning signal line $G_i$.

The emission driver 700 keeps the emission signal $V_{si}$ to be equal to the high level voltage Von in response to the emission control signals CONT3 from the signal controller 600, thereby maintaining the switching transistors Qs4-Qs6 to be turned on.

FIG. 6A shows an equivalent circuit of a pixel in this state, and this period is referred to as a precharging period T1. The switching transistors Qs2, Qs3, Qs4, and Qs6 can be represented as resistors r1, r2, r3, and r4, respectively, as shown in FIG. 6A.

Since a terminal N1 of the capacitor Cst and the control terminal Ng of the driving transistor Qd are connected to the driving voltage Vdd through the resistor r3, their voltages are equal to the driving voltage Vdd subtracted by a voltage drop of the resistor r3 and maintained by the capacitor Cst. At this time, it is preferable that the driving voltage Vdd is higher than the data voltage Vdata to turn on the driving transistor Qd.

Then, the driving transistor Qd turns on to supply a current to the light emitting element LD, thereby emitting light from the light emitting element LD. However, the precharging period T1 is very short compared with one frame and thus the light emission in the precharging period T1 is negligible and does not affect a target luminance.

Next, a main charging period T2 starts when the emission driver 700 changes the emission signal $V_{si}$ to the low level voltage Voff to turn off the switching transistors Qs4-Qs6. Since the scanning signal $V_{gi}$ maintains the high level voltage Von in this period T2, the switching transistors Qs1-Qs3 keep their conduction state.

Referring to FIG. 6B, the driving transistor Qd is separated from the driving voltage Vdd and the light emitting element LD and it becomes in a diode connection. In detail, the control terminal Ng and the input terminal Nd of the driving transistor Qd are connected to each other and separated from the driving voltage Vdd, and the output terminal Ns of the driving transistor Qd is separated from the light emitting element LD, but still being supplied with the data voltage Vdata. Since the control terminal voltage Vng of the driving transistor Qd is sufficiently high, the driving transistor Qd maintains its conduction state.

Therefore, the capacitor Cst begins to discharge its voltage precharged in the precharging period T1 through the driving transistor Qd and the control terminal voltage Vng of the driving transistor Qd becomes lower as shown in FIG. 7. The voltage drop of the control terminal voltage Vng continues until the voltage Vgs between the control terminal Ng and the output terminal Ns of the driving transistor Qd is equal to the threshold voltage Vth of the driving transistor Qd such that the driving transistor Qd supplies no more current.

That is, $$Vgs=Vth \quad (1)$$

Then, the voltage Vc stored in the capacitor Cst is given by:

$$Vc=Vdata+Vth-Vref. \quad (2)$$

Accordingly, the voltage stored in the capacitor Cst depends only on the data voltage Vdata and the threshold voltage Vth of the driving transistor Qd.

After the voltage Vc is stored in the capacitor Cst, the scanning driver 400 changes the scanning signal $V_{gi}$ to the low level voltage Voff to turn off the switching transistors Qs1-Qs3, which is referred to as a cut off period T3. Since the emission signal $V_{si}$ keeps the low level voltage Voff in this period T3, the switching transistors Qs4-Qs6 maintain their off states.

Referring to FIG. 6C, the input terminal Nd and the output terminal Ns of the driving transistor Qd are opened and so is the terminal N2 of the capacitor Cst. Accordingly, there is not inflow and outflow of charges for the circuit and the capacitor Cst maintains its voltage Vc stored in the main charging period T2.

After a predetermined time elapses from the turn off of all the switching transistors Qs1-Qs6, the emission driver 700 changes the emission signal $V_{si}$ into the high level voltage Von to turn on the switching transistors Qs4-Qs6 such that an emission period T4 starts. Since the scanning signal $V_{gi}$ maintains its low level voltage Voff in this period T4, the switching transistors Qs1-Qs3 are still in off states.

Referring to FIG. 6D, the capacitor Cst is connected between the control terminal Ng and the output terminal Ns of the driving transistor Qd, the input terminal Nd of the driving transistor Qd is connected to the driving voltage Vdd, and the output terminal Ns of the driving transistor Qd is connected to the light emitting element LD.

Referring to FIG. 7, since the terminal N1 of the capacitor Cst is opened, the voltage Vgs between the control terminal voltage Vng and the output terminal voltage Vns of the driving transistor Qd becomes equal to the voltage Vc stored in the capacitor Cst (i.e., Vgs=Vc), the driving transistor Qd supplies the output current $I_{LD}$ to the light emitting element LD, which has a magnitude controlled by the voltage Vgs. Accordingly, the light emitting element LD emits light having an intensity depending on the magnitude of the output current $I_{LD}$, thereby displaying an image.

Since the capacitor Cst maintains the voltage Vc stored in the main charging period T2 (i.e., Vc=Vdata+Vth−Vref) regardless of the load exerted by the light emitting element LD, the output current $I_{LD}$ is expressed as follows:

$$\begin{aligned} I_{LD} &= \frac{1}{2}k(Vgs - Vth)^2 \\ &= \frac{1}{2}k(Vdata + Vth - Vref - Vth)^2 \\ &= \frac{1}{2}k(Vdata - Vref)^2. \end{aligned} \quad (3)$$

Here, k is a constant depending on the characteristic of the transistor and given by an equation k=μ·Ci·W/L, where μ denotes field effect mobility, Ci denotes a capacitance of an insulator disposed between a control terminal and a channel, W denotes the channel width, and L denotes the channel length.

Referring to Relation 3, the output current $I_{LD}$ in the emission period T4 is determined only by the data voltage Vdata and the reference voltage Vref. Therefore, the output current $I_{LD}$ is affected neither by the change of the threshold voltage Vth of the driving transistor Qd nor by the change of the threshold voltage $Vth_{LD}$ of the light emitting element LD.

As a result, the OLED according to the embodiment of the present invention compensates for the change of the threshold voltage Vth of the driving transistor Qd and the threshold voltage $Vth_{LD}$ of the light emitting element LD.

In the meantime, if the emission period T4 starts immediately after the main charging period T2 finishes, the switching transistor Qs4 may turn on before the switching transistor Qs1 turns off such that the charge carriers from the driving voltage Vdd enter into the capacitor Cst, thereby changing the voltage Vc stored in the capacitor Cst. The cut off period T3 disposed between the main charging period T2 and the emission period T4 ensures that the switching transistor Qs4 turns on after the switching transistor Qs1 turns off.

The emission period T4 continues until the precharging period T1 for the corresponding pixels starts again in the next frame. The operation of the OLED in the periods T1-T4 repeats for the next group of pixels. However, it is noted that the precharging period T1 for the (i+1)-th pixel row, for example, starts after the main charging period T2 for the i-th pixel row finishes. In this way, the operations in the periods T1-T4 are performed for all the pixels to display images.

The length of the periods T1-T4 may be adjusted.

The reference voltage Vref may be equal to the common voltage Vss, for example, equal to 0V. Otherwise, the reference voltage Vref may have a negative voltage level. In this case, the data voltages Vdata supplied from the data driver 500 can be reduced. The driving voltage Vdd preferably have a magnitude, for example, equal to 20V sufficient for supplying charge carriers to the capacitor Cst and for making the driving transistor Qd generate the output current $I_{LD}$.

The simulations were performed for the change of the threshold voltages, which will be described in detail with reference to FIGS. 8 and 9.

Figure 8:
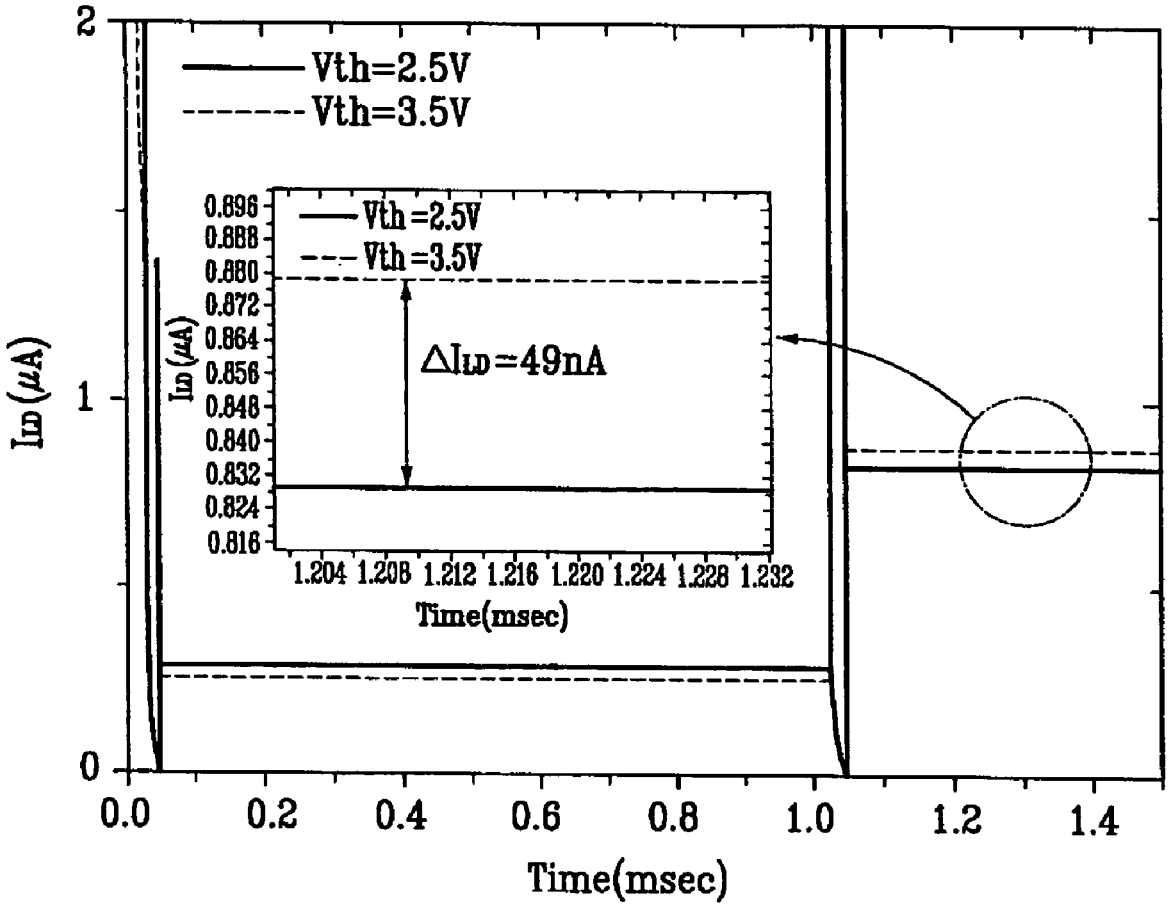
FIG. 8 illustrates waveforms of the output current for different threshold voltages of the driving transistor.
Figure 9:
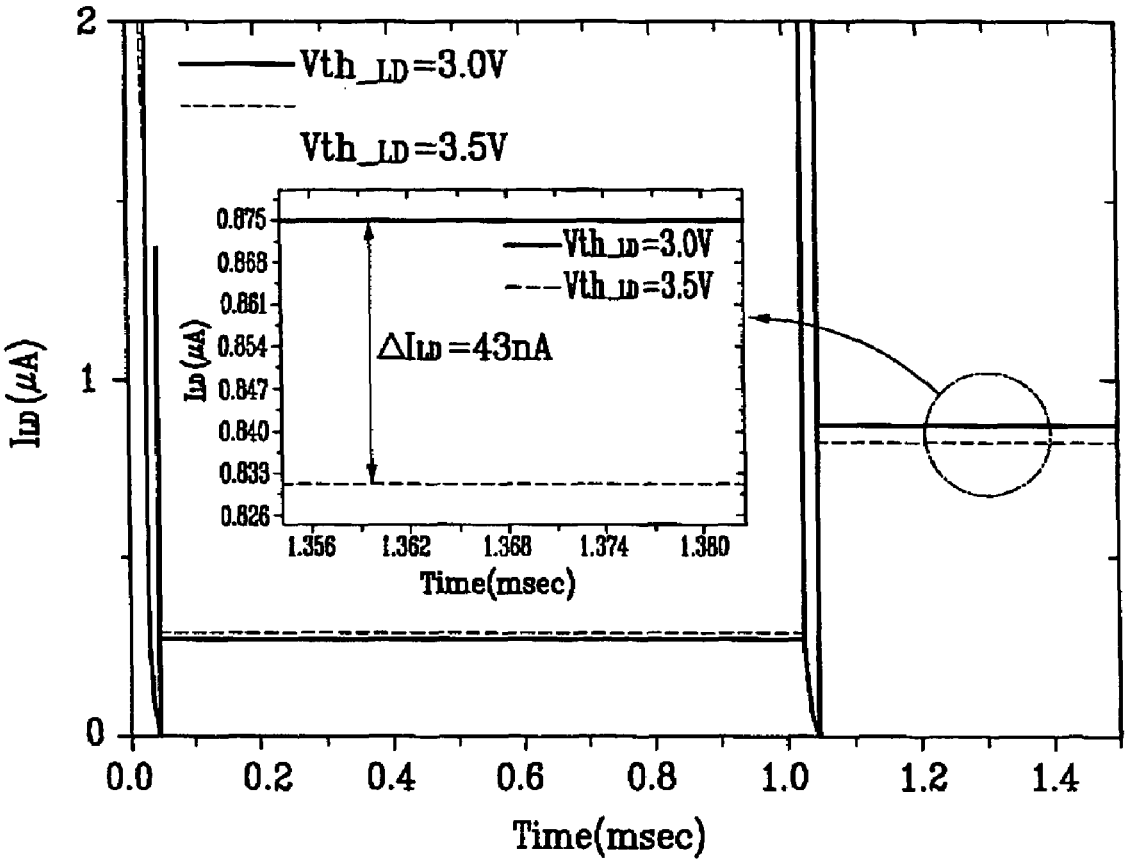
FIG. 9 illustrates waveforms of the output current for different threshold voltages of the light emitting element.

FIG. 8 illustrates waveforms of the output current for different threshold voltages of the driving transistor, and FIG. 9 illustrates waveforms of the output current for different threshold voltages of the light emitting element.

The simulations were performed using SPICE. The simulations were performed under the condition that the driving voltage Vdd is equal to 20V, the common voltage Vss and the reference voltage Vref are equal to 0V, and the data voltage Vdata is equal to 2V in the first frame (before the time of about 1 msec in FIG. 8) and equal to 3.3 V in the second frame.

FIG. 8 shows the variation of the output current $I_{LD}$ when the threshold voltage Vth of the driving transistor Qd changes from 2.5V to 3.5V. The current of the light emitting element LD, i.e., the output current $I_{LD}$ in the second frame was equal to about 831 nA for the threshold voltage Vth of 2.5V and equal to about 880 nA for the threshold voltage Vth of 3.5V. Accordingly, when the threshold voltage Vth of the driving transistor Qd is increased by 1V, the variation of the current was about 49 nA, which is 5.8% with respect to the initial current.

FIG. 9 shows the variation of the output current $I_{LD}$ when the threshold voltage $Vth_{LD}$ of the light emitting element LD changes from 3V to 3.5V. The output current $I_{LD}$ in the second frame was equal to about 874 nA for the threshold voltage $Vth_{LD}$ of 3V and equal to about 831 nA for the threshold voltage $Vth_{LD}$ of 3.5V. Accordingly, when the threshold voltage $Vth_{LD}$ of the light emitting element LD is increased by 0.5V, the variation of the current was about 43 nA, which is 5.1% with respect to the initial current.

These variations of the output current $I_{LD}$ are negligible compared with a conventional OLED including two driving transistors per one pixel.

The simulations show that the OLED according to the embodiment of the present invention compensates for the change of the threshold voltage Vth of the driving transistor Qd and the threshold voltage $Vth_{_LD}$ of the light emitting element LD.

Although preferred embodiments of the present invention have been described in detail hereinabove, it should be clearly understood that many variations and/or modifications of the basic inventive concepts herein taught which may appear to those skilled in the present art will still fall within the spirit and scope of the present invention, as defined in the appended claims.

What is claimed is:

1. A display device comprising a plurality of pixels, each pixel including:

a light emitting element;

a capacitor;

a driving transistor that has a control terminal, an input terminal, and an output terminal and supplies a driving current to the light emitting element to emit light;

a first switching unit that diode-connects the driving transistor and supplies a data voltage directly to the output terminal of the driving transistor in response to a scanning signal; and a second switching unit that supplies a driving voltage to the input terminal of the driving transistor and connects the light emitting element and the capacitor to the output terminal of the driving transistor in response to an emission signal, wherein the capacitor is connected to the driving transistor through the first switching unit, stores a control voltage, the control voltage being a function of the data voltage and the threshold voltage of the driving transistor, and is connected to the driving transistor through the second switching unit to supply the control voltage to the driving transistor.

2. The display device of claim 1, wherein the first switching unit comprises:

a first switching transistor connecting the control terminal and the input terminal of the driving transistor in response to a scanning signal; and a second switching transistor connecting the output terminal of the driving transistor to the data voltage in response to the scanning signal.

3. The display device of claim 2, wherein the switching unit further comprises a third switching transistor supplies a reference voltage to the capacitor in response to the scanning signal.

4. The display device of claim 3, wherein the second switching unit comprises:

a fourth switching transistor connecting the input terminal of the driving transistor to the driving voltage in response to the emission signal;

a fifth switching transistor connecting the light emitting element and the output terminal of the driving transistor in response to the emission signal; and a sixth switching transistor connecting the capacitor and the output terminal of the driving transistor in response to the emission signal.

5. The display device of claim 4, wherein the control voltage is equal to sum of the data voltage and the threshold voltage subtracted by the reference voltage.

6. The display device of claim 4, wherein the first to the sixth switching transistors and the driving transistor comprise amorphous silicon thin film transistors.

7. The display device of claim 4, wherein the first to the sixth switching transistors and the driving transistor comprise NMOS thin film transistors.

8. The display device of claim 4, wherein the light emitting element comprises an organic light emitting layer.

9. A display device comprising:

a light emitting element;

a driving transistor having a first terminal connected to a first voltage, a second terminal connected to the light emitting element, and a control terminal;

a capacitor connected between the second terminal and the control terminal of the driving transistor;

a first transistor that operates in response to a scanning signal and is connected between the first terminal and the control terminal of the driving transistor;

a second transistor that operates in response to the scanning signal and is connected between the second terminal of the driving transistor and a data voltage;

a third transistor that operates in response to an emission signal and is connected between the first voltage and the first terminal of the driving transistor;

a fourth transistor that operates in response to the emission signal and is connected between the light emitting element and the second terminal of the driving transistor; and a fifth transistor that operates in response to the emission signal and is connected between the capacitor and the second terminal of the driving transistor.

10. The display device of claim 9, further comprising a sixth transistor that operates in response to the scanning signal and is connected between the capacitor and a second voltage.

11. The display device of claim 10, wherein during first to fourth time periods in series, the first to the sixth transistors turn on during the first time period;

the first, the second, and the sixth transistors turn on and the third to fifth transistors turn off during the second time period;

the first to the sixth transistors turn off during the third time period; and the first, the second, and the sixth transistors turn off and the third to fifth transistors turn on during the fourth time period.

12. The display device of claim 11, wherein the first voltage is higher than the data voltage and the second voltage is lower than the data voltage.

13. A method of driving a display device including a light emitting element, a driving transistor having a control terminal and first and second terminals, and a capacitor connected to the control terminal of the driving transistor, the method comprising:

connecting the control terminal and the first terminal of the driving transistor;

applying a data voltage directly to the second terminal of the driving transistor;

applying a reference voltage to the capacitor;

connecting the capacitor between the control terminal and the second terminal of the driving transistor;

connecting the first terminal of the driving transistor to a driving voltage; and connecting the second terminal of the driving transistor to the light emitting element.

14. The method of claim 13, further comprising:

applying a first voltage higher than the data voltage to the control terminal of the driving transistor to charge the capacitor.

15. The method of claim 14, further comprising:

isolating the control terminal and the first terminal of the driving transistor after the connection of the control terminal and the first terminal of the driving transistor.

16. The method of claim 15, further comprising:

separating the capacitor and the driving transistor from external signal sources.

* * * * *

UNITED STATES PATENT AND TRADEMARK OFFICE

CERTIFICATE OF CORRECTION

PATENT NO. : 7,710,366 B2
APPLICATION NO. : 11/133878
DATED : May 4, 2010
INVENTOR(S) : Jae-Hoon Lee It is certified that error appears in the above-identified patent and that said Letters Patent is hereby corrected as shown below:

On the title page, item [73] should read:

Assignee(s): Samsung Electronics Co., Ltd.
Gyeonggi-do (KR)

Seoul National University Industry Foundation
Seoul (KR)

Signed and Sealed this
Fifth Day of July, 2011

David J. Kappos

David J. Kappos
*Director of the United States Patent and Trademark Office*